US006684655B2

(12) United States Patent
Terauchi

(10) Patent No.: US 6,684,655 B2
(45) Date of Patent: Feb. 3, 2004

(54) CAPACITY CONTROL APPARATUS FOR COMPRESSORS

(75) Inventor: Kiyoshi Terauchi, Isesaki (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 10/197,868

(22) Filed: Jul. 19, 2002

(65) Prior Publication Data

US 2003/0029181 A1 Feb. 13, 2003

(30) Foreign Application Priority Data

Aug. 8, 2001 (JP) ..... P2001-240414

(51) Int. Cl.[7] ..... F25B 1/00; F25B 49/00
(52) U.S. Cl. ..... 62/228.5; 417/222.2
(58) Field of Search ..... 62/228.5; 417/222.2, 417/222.1, 269, 270, 213; 74/60

(56) References Cited

U.S. PATENT DOCUMENTS

| | | | | |
|---|---|---|---|---|
| 4,498,311 A | | 2/1985 | Sakano et al. | |
| 4,539,821 A | | 9/1985 | Tamura | |
| 4,547,133 A | * | 10/1985 | Nishizawa et al. | 417/270 |
| 4,780,059 A | | 10/1988 | Taguchi | |
| 5,065,589 A | | 11/1991 | Taguchi | |
| 5,094,589 A | | 3/1992 | Terauchi et al. | |
| 5,145,325 A | | 9/1992 | Terauchi | |
| 5,165,863 A | | 11/1992 | Taguchi | |
| 5,191,768 A | * | 3/1993 | Fujii | 62/209 |
| 6,212,893 B1 | * | 4/2001 | Ban et al. | 62/117 |
| 6,373,677 B1 | | 4/2002 | Ikeda | |
| 6,453,685 B2 | * | 9/2002 | Ota et al. | 62/115 |
| 6,474,083 B2 | | 11/2002 | Taguchi | |
| 6,481,976 B2 | * | 11/2002 | Kimura et al. | 417/222.2 |
| 6,578,372 B2 | * | 6/2003 | Fukanuma et al. | 62/115 |
| 2002/0104321 A1 | * | 8/2002 | Odachi et al. | 62/133 |

FOREIGN PATENT DOCUMENTS

| | | |
|---|---|---|
| JP | 6473178 | 3/1989 |
| JP | 5164045 | 6/1993 |

* cited by examiner

*Primary Examiner*—Marc Norman
(74) *Attorney, Agent, or Firm*—Baker Botts L.L.P.

(57) ABSTRACT

An apparatus for controlling compressor discharge capacity includes a variable capacity compressor, a capacity adjustment device, a signal processing device, a capacity setting device, and a signal comparing device. The capacity adjustment device regulates a discharge capacity of the variable capacity compressor. The signal processing device receives a signal corresponding to a discharge capacity of the variable capacity compressor. The capacity setting device sets a first discharge capacity target value for the variable capacity compressor. The signal comparing device compares the discharge capacity signal to the fist discharge capacity target value and sends an activation signal to the capacity adjustment device, such that the discharge capacity signal approaches the first discharge capacity value.

22 Claims, 2 Drawing Sheets

CAPACITY CONTROL APPARATUS FOR COMPRESSORS

BACKGROUND OF THE INVENTION

1. Field of the Invention

The present invention relates generally to a capacity control apparatus for variable capacity-type compressors for use in automotive air conditioning systems. In particulars the present invention relates to a capacity control apparatus that may directly control an actual discharge capacity of variable capacity-type compressors, and which may be used to control refrigeration circuits in automotive air conditioning systems 2. Description of Related Art A capacity control apparatus for a variable capacity-type compressor is described in, for example, Japanese (Unexamined) Patent Publication No. 64-073178. In this known variable capacity-type compressor, a discharge capacity of the compressor is regulated by a control means, e.g., an electromagnetic valve or the like. The control means regulates the discharge capacity of the compressor based on a measured physical characteristic related to cooling efficiency of a refrigeration circuit, e.g., a pressure or a temperature of a refrigerant.

In this known variable capacity-type compressor, the actual discharge capacity of the compressor may be adjusted, as needed. For example, the discharge capacity of the compressor may be adjusted in response to a condition of the refrigeration circuit, e.g., to an increased air conditioning load on the refrigeration circuit. Moreover, actual discharge capacity of the compressor may be adjusted toward a predetermined discharge capacity target of the compressor. For example, a target discharge capacity value of the compressor may be established, and the actual discharge capacity may be adjusted toward the target discharge capacity value. Therefore, in such known variable capacity type compressors, in which an engine of a vehicle may drive the compressor, a load fluctuation of the compressor may not correspond to a load of the engine. As a result, efficient operation of the compressor may not be achieved.

In order to improve the efficiency of such compressors, such compressors may include a discharge capacity control apparatus for a variable capacity-type compressor, as described in Japanese Patent No. 3060676. In this known variable capacity-type compressor, a torque detection device is positioned on the compressor to measure a torque of a drive of the compressor, e.g., a torque of a drive shaft of a compressor or the like. An output of a vehicle engine then may be adjusted based on the measured value of torque driving the compressor.

Nevertheless, in known variable capacity-type compressors having such a torque detection device, the compressor load is measured, and this measurement is used to control the air conditioning system of the vehicle. Nevertheless, the discharge capacity of the compressor is not adjusted toward a predetermined target discharge value of the compressor.

SUMMARY OF THE INVENTION

Therefore, a need has arisen for a discharge capacity, control apparatus for variable capacity-type compressors that regulates operation of the compressor, so that the compressor discharge capacity approaches or reaches a discharge capacity target value.

According to an embodiment of the present invention, an apparatus for controlling compressor discharge capacity comprises a variable capacity compressor, a capacity adjustment device, a signal processing device, a capacity setting device, and a signal comparing device. The capacity adjustment device regulates a discharge capacity of the variable capacity compressor. The signal processing device receives a signal corresponding to a discharge capacity of the variable capacity compressor. The capacity setting device sets a first discharge capacity target value for the variable capacity compressor. The signal comparing device compares the discharge capacity signal to the first discharge capacity target value and second an activation signal to the capacity adjustment device, such that the discharge capacity signal approaches the first discharge capacity target value.

In another embodiment of the invention, an apparatus for controlling compressor discharge capacity comprises a variable capacity compressor, a capacity adjustment device, a signal processing device, a capacity setting device, a first signal comparing device, a detection device a pressure setting device, and a second signal comparing device. The capacity adjustment device regulates a discharge capacity of the variable capacity compressor. The signal processing device receives a signal corresponding to a discharge capacity of said variable capacity compressor. The capacity setting device sets a first discharge capacity target value of the variable capacity compressor. The first signal comparing device compares the discharge capacity signal to the first discharge capacity target value and sends a first activation signal to the capacity adjustment device, such that the discharge capacity signal reaches the first discharge capacity value. The detection device detects a first pressure value in a refrigeration circuit including the variable capacity compressor. A pressure setting device sets a second pressure target value. A second signal comparing device compares the first pressure value with the second pressure target value and sends an activation signal to the capacity adjustment device, such that the first pressure value approaches the second pressure target value. The compressor discharge capacity controlling apparatus may comprise a switching device that selectively connects the first signal comparing device and the second signal comparing device to the capacity adjustment device.

In another embodiment of the invention, an apparatus for controlling compressor discharge capacity comprises a variable capacity compressor, a capacity adjustment device, a signal processing device, a capacity setting device, a first signal comparing device, a detection device, a temperature setting device, and a second signal comparing device. The capacity adjustment device regulates a discharge capacity of the variable capacity compressor. The signal processing device receives a signal corresponding to a discharge capacity of said variable capacity compressor. The capacity setting device sets a first discharge capacity target value of the variable capacity compressor. The first signal comparing device compares the discharge capacity signal to the first discharge capacity target value and sends an activation signal to the capacity adjustment device, such that the discharge capacity signal reaches the first discharge capacity value. The detection device detects a first temperature value in a refrigeration circuit including the variable capacity compressor. A temperature setting device sets a second temperature target value. A second signal comparing device compares the first temperature value with the second temperature target value and sends an activation signal to the capacity adjustment device, such that the first temperature value approaches the second temperature target value. The compressor discharge capacity controlling apparatus may comprise a switching device that selectively connects the first signal comparing device and the second signal comparing device to the capacity adjustment device.

According to a further embodiment of the invention, a method of controlling a discharge capacity of a variable capacity compressor connected to a refrigeration circuit comprises the following steps. A first discharge capacity value of the variable capacity compressor is set. A discharge capacity of the variable capacity compressor is detected. The discharge capacity value is compared with the first discharge capacity target value. The discharge capacity of the variable capacity compressor is adjusted, such that the discharge capacity value approaches the first discharge capacity value.

Other objects, features, and advantages of embodiments of this invention will be apparent to persons of ordinary skill in the art from the following detailed description of the invention and the accompanying drawings.

BRIEF DESCRIPTION OF THE DRAWINGS

The present invention may be understood more readily with reference to the following drawings.

DETAILED DESCRIPTION OF PREFERRED EMBODIMENTS

Where features of the following embodiments of the present invention are substantially similar to those of other embodiments, similar parts have been given similar numbers, and explanations for these similar parts may be omitted from the descriptions of subsequent embodiments.

Figure 1:
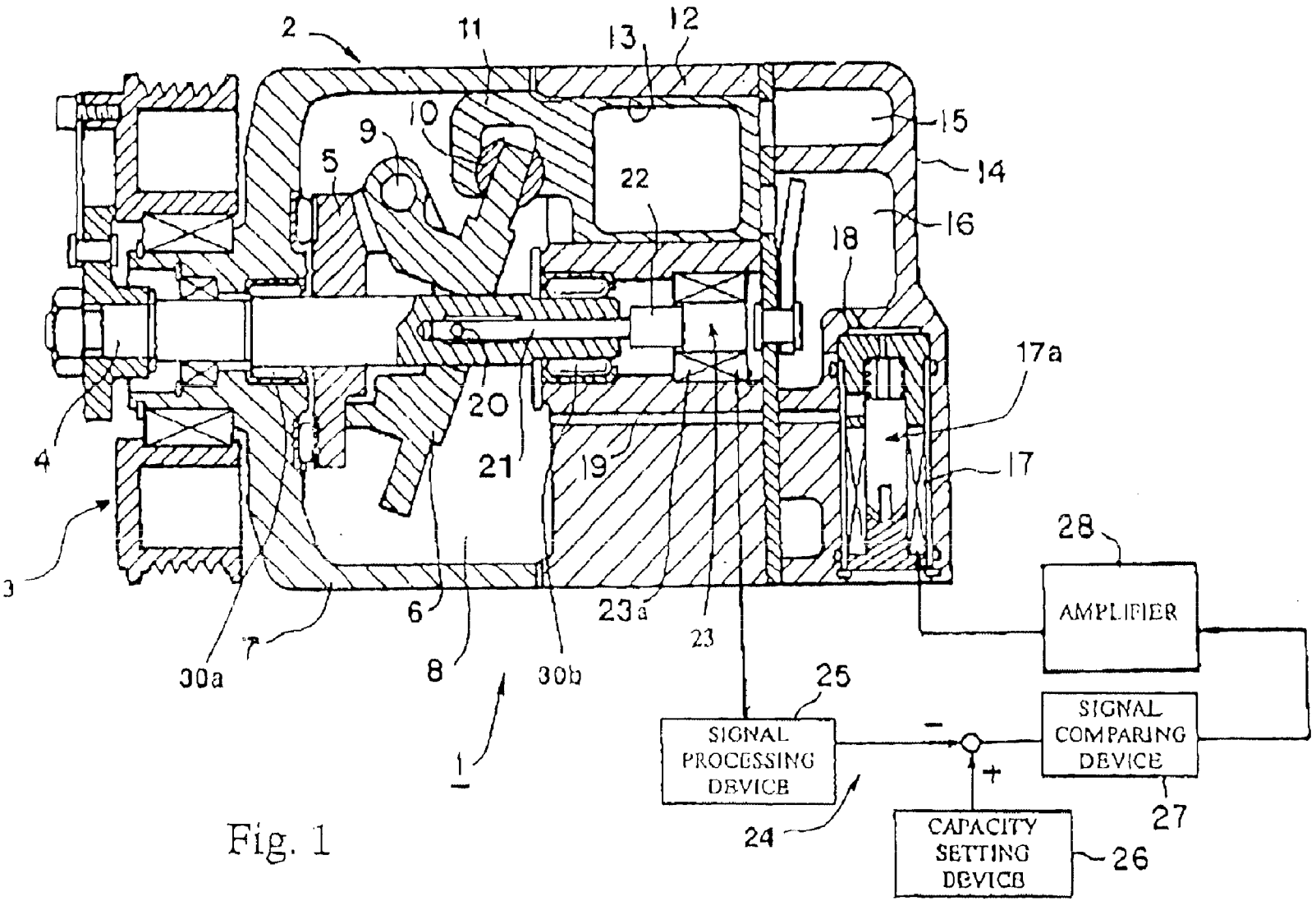
FIG. 1 shows a schematic of a capacity control apparatus of a compressor, according to an embodiment of the present invention.

FIG. 1 shows a discharge capacity control mechanism 1 of a variable capacity-type compressor 2 for a vehicle air conditioning system according to an embodiment of the present invention. Variable capacity-type compressor 2 may be a swash plate-type compressor. Variable capacity-type compressor 2 may comprise a cylinder block 12, a front housing 7, and a cylinder head 14. Cylinder block 12 may be substantially cylindrical. Front housing 7 may be positioned at one end of cylinder block 12. Cylinder head 14 may be positioned at another end of cylinder block 12. A crank chamber 8 may be formed between cylinder block 12 and front housing 7. Moreover, a suction chamber 15 and a discharge chamber 16 may be formed within cylinder head 14. Cylinder block 12, front housing 7, and cylinder head 14 may be connected by a plurality of fasteners, e.g., bolts (not shown). Compressor 2 also may comprise a plurality of cylinder bores 13 formed in cylinder block 12. Cylinder bores 13 may be positioned around a central axis of cylinder block 12, e.g., in an annular configuration, and may be offset radially from the central axis of cylinder block 12.

Compressor 2 may comprise a drive shaft 4, a cam rotor 5, a swash plate 6, a plurality of pairs of shoes 10, and a plurality of pistons 11. Drive shaft 4 may extend through crank chamber 8, alone a central axis of compressor 2. Drive shaft 4 may be supported rotatably by front housing 7 and cylinder block 12, via bearings 30*a* and 30*b*, which may be mounted in front housing 7 and cylinder block 12, respectively. Compressor 2 may comprise an electromagnetic clutch 3. A drive belt (not shown) may engage a pulley of electromagnetic clutch 3 and transmit a driving force from a driving source (not shown), e.g., an engine of a vehicle, to electromagnetic clutch 3. When electromagnetic clutch 3 engages drive shaft 4, the driving force off the driving source may be transmitted by electromagnetic clutch 3 to drive shaft 4. Moreover, cam rotor 5 may be fixed to drive shaft 4 to rotate with drive shaft 4 and may be positioned within crank chamber 8. Swash plate 6 also may be positioned within crank chamber 8 and may be slidably mounted on drive shaft 4. Swash plate 6 may be connected to cam rotor 5 via hinge mechanism 9, so that an inclination angle of swash plate 6 may vary, and so that swash plate 6 may rotate with drive shaft 4. Although electromagnetic clutch 3 may transmit the driving force of the driving source to drive shaft 4, the driving source may be coupled directly to drive shaft 4 in another embodiment of the present invention.

A piston 11 may be positioned within each cylinder bore 13, so that each piston 11 may reciprocate independently within its respective cylinder bore 13. Each piston 11 may include a pair of substantially semispherical cavities, which may be formed at an end of each piston 11. Each piston 11 may be connected to swash plate 6, via a pair of shoes 10. Each shoe 10 comprises a semispherical portion and a flat portion. A semispherical portion of each shoe may be positioned in a respective semispherical cavity of each piston 11, while a flat portion of each shoe may contact a surface of swash plate 6. In this way, each shoe of a pair of shoes 10 may slidably contact a surface of swash plate 6.

Compressor 2 may comprise a discharge capacity adjustment device 17*a* which may adjust a discharge capacity of compressor 2. Capacity adjustment device 17*a* may comprise an electromagnetic control valve 17, a first communication path 18, and a second communication path 19. First communication path 18 and second communication path 19 may establish communication between discharge chamber 16 and crank chamber 8. Electromagnetic control valve 17 may be positioned between first communication path 18 and second communication path 19. Electromagnetic control valve 17 may be opened to enable fluid communication between first communication path 18 and second communication path 19 or closed to prevent fluid communication between first communication path 18 and second communication path 19. In this way, electromagnetic control valve 16 may control the amount of refrigerant that flows between crank chamber 8 and discharge chamber 16.

Capacity adjustment device 17*a* may control the discharge capacity of compressor 2 in the following manner. The discharge capacity of compressor 2 may vary with a length of a stroke of each piston 11. The length of a stroke of each piston. 11 may vary with the inclination angle of swash plate 6. The inclination angle of swash plate 6 may be controlled by controlling a pressure in crank chamber 8. The pressure in crank chamber 8 may be controlled by controlling the amount of a refrigerant, e.g., a refrigerant gas, that passes between crank chamber 8 and discharge chamber 16, via first communication path 18 and second communication path 19. By controlling the amount of refrigerant that flows between crank chamber 8 and discharge chamber 16 via first communication path 18 and second communication path 19, capacity adjustment device 17*a* may control the inclination angle of swash plate 6 and the stroke length of each piston 11, thereby enabling capacity adjustment device 17*a* to control the discharge capacity of compressor 2.

A rod 21 may be positioned within drive shaft 4 and may slide in an axial direction within drive shaft 4, i.e., in a direction substantially parallel to a longitudinal axis of drive shaft 4. Swash plate 6 may be connected to rod 21, via a pin 20. Rod 21 may slide within drive shaft 4 in an axial direction in response to changes in the inclination angle of swash plate 6. Thus, a position of rod 21 in an axial direction within drive shaft 4 corresponds to an inclination angle of swash plate 6. A detection member 22 may be positioned at an end of rod 21 that projects from drive shaft 4. A position sensor 23*a* may detect a position of detection member 22. Thus, a position of rod 21 and an inclination angle of swash plate 6 may be detected by position sensor 23*a*, via detection of a position of detection member 22. Because the discharge capacity of compressor 2 and stroke length of each piston correspond to the inclination angle of swash plate 6, the discharge, capacity of compressor 2 may be measured by detecting a position of detection member 22. Moreover, the discharge capacity of compressor 2 and the stroke length of each piston 11 may be converted to a position of rod 21, via swash plate 6 and pin 20, such that a discharge capacity of compressor 2 may be derived from a detected position of rod 21. This mechanism constitutes a capacity detection device 23 according to an embodiment of the invention.

A capacity control device 24 may be connected to position sensor 23*a* of capacity detection device 23 and electromagnetic control valve 17 of capacity adjustment device 17*a*. Capacity control device 24 may comprise a signal processing device 25, e.g., an electric circuit, a capacity setting device 26, e.g., an electric circuit, a signal comparing device 27, e.g., an electric circuit, and an amplifier 28 for energizing a solenoid of electromagnetic valve 17. Signal processing device 25 may receive signals from position sensor. 23*a* of capacity detection device 23. Each signal may correspond to a position of detection member 22 and rod 21 detected by position sensor 23*a* of capacity detection device 23 and thus to a position of swash plate 6 and to a discharge capacity of compressor 2.

Capacity setting device 26 may establish a compressor discharge capacity target value. Signal comparing device 27 may compare the detected signal received from signal processing device 25 to the compressor discharge capacity target value. Based on the comparison, signal comparing device 21 may transmit a feedback value signal to amplifier 28. Feedback value signal may be based on a difference, if any, between the detected signal and the compressor discharge capacity target value. In response to the received feedback value signal, amplifier 28 transmits an activation signal to electromagnetic valve 17 to energize the solenoid of electromagnetic control valve 17. Thus, by establishing compressor discharge capacity target values, capacity setting device 26 may control a pressure in crank chamber 8, thereby controlling the discharge capacity of compressor 2 based on the compressor discharge capacity target value. Each compressor discharge capacity target value may be selected from values in a range of about 0% of a discharge capacity target value to about 100% of a discharge capacity target According to this embodiment of the invention, the discharge capacity of compressor 2 may be detected directly, i.e., by detecting a position of rod detection member 22 and rod 21, and by converting that detected position to a corresponding discharge capacity of compressor 2. This detected discharge capacity may be compared to a predetermined discharge capacity target value, so that the discharge capacity of compressor 2 may be regulated without regard to other factors that may affect the discharge capacity of compressor 2. For example, a feedforward control may be used to adjust the discharge capacity of compressor 2, so that the detected value of a position of rod 21 and, thus, the discharge capacity of compressor 2 may approach and eventually reach a discharge capacity target value.

Figure 2:
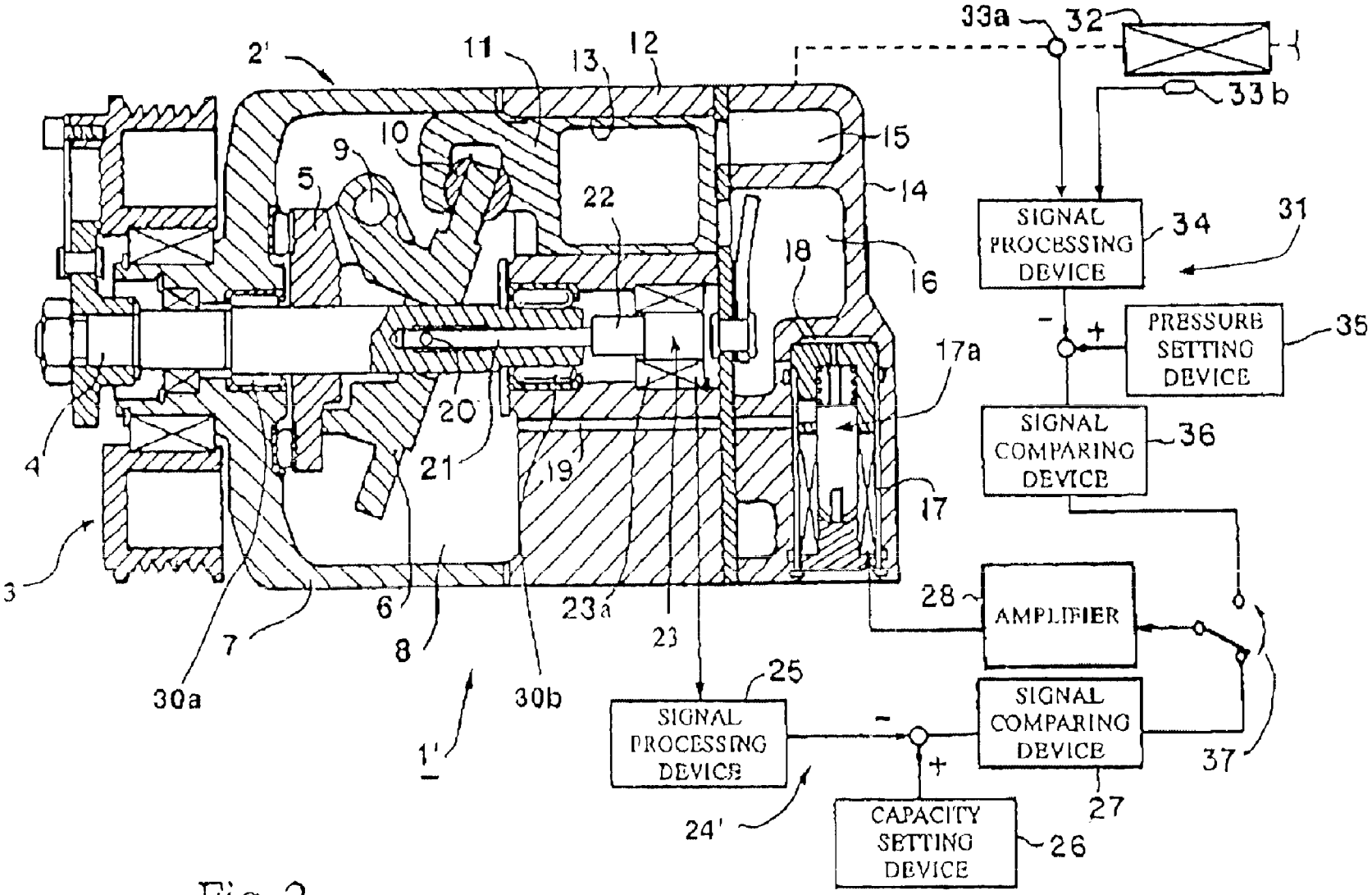
FIG. 2 shows a schematic of a capacity control apparatus of a compressor, according to another embodiment of the present invention.

FIG. 2 shows a discharge capacity control mechanism 1' of a variable capacity-type compressor 2' for a vehicle air conditioning system according to a further embodiment of the present invention. In this embodiment of the invention, the configuration of discharge capacity control mechanism 1' may be substantially similar to the configuration of discharge capacity control mechanism 1 of the previous embodiment, except that discharge capacity control mechanism 1' may comprise a second capacity control device 31. Second capacity control device 31 may control the discharge capacity of compressor 2' through a feedback control based on a signal that corresponds to a detected pressure or a detected tempera of a refrigeration circuit. Moreover, discharge capacity control mechanism 1' may comprise first capacity control device 24' in addition to second capacity control device 31, so that a discharge capacity of compressor 2 may be regulated by first capacity control device 24' via a feedback control based on a signal that corresponds to a detected position, of rod 21, as discussed in the previous embodiment, or through a, feedback control based on a signal that corresponds to a detected pressure or a detected temperature of a refrigeration circuit. According to this embodiment, a switching device 37 may connect second capacity control device 31 or first capacity control device 24' to amplifier 28.

Second capacity control device 31 may comprise a sensor, e.g., a pressure sensor 33*a*, a temperature sensor 33*b*, or the like, a signal processing device 34, e.g., an electric circuit, a pressure setting device 35, e.g., an electric circuit, a signal comparing device 36, e.g., an electric circuit, and an amplifier 28 for energizing a solenoid of electromagnetic valve 17. Pressure sensor 33*a* may be positioned in a refrigeration circuit. For example, pressure sensor 33*a* may be positioned between a suction chamber 15 of compressor 2' and an evaporator 32 to detect a pressure of refrigerant in the refrigeration circuit, e.g., a pressure of refrigerant in suction chamber 15 of compressor 2'. Pressure setting device 35 may set a pressure control target value. Signal comparing device 36 may compare the pressure detected by pressure sensor 33*a* with the predetermined pressure control target value set by pressure setting device 35. Based on this comparison, signal comparing device 36 may transmit a feedback value signal to amplifier 28. The feedback value signal may correspond to a difference, if any, between the pressure detected by pressure sensor, 33*a* and the predetermined pressure control target value set by pressure setting device 35. Amplifier 28 may transmit a signal to electromagnetic valve 17 to energize the solenoid of electromagnetic control valve 17.

Thus, the discharge capacity of compressor 2' may be controlled by detection a pressure of a refrigerant in a refrigeration circuit and by comparing the detected pressure to a predetermined pressure control target value set by pressure setting device 35. A feedforward control or the like, may be used to control second capacity control device 31, so that the detected pressure value approaches and reaches the predetermined target pressure control value.

In another embodiment of the invention, a temperature sensor 33*b* may detect a temperature of refrigeration circuit, e.g., a temperature of fins of evaporator 32, a temperature of air passing through evaporator 32, or the like. Pressure setting device 35 may set a temperature control target value. Signal comparing device 36 may compare the temperature detected by temperature sensor 33*b* with the temperature control target value set by pressure setting device 35. Based on this comparison, signal comparing device 36 may transmit a feedback value signal to amplifier 28. The feedback value signal may correspond to a difference, if any, between the temperature detected by temperature sensor 33*a* and the temperature control target value set by pressure setting device 35. Amplifier 28 may transmit a signal to electromagnetic valve 17 to energize the solenoid of electromagnetic control valve 17. Thus, capacity control device 31 enables regulation of the discharge capacity of compressor 2', via the detected temperature of evaporator 32 or the detected pressure of refrigerant in the refrigeration circuit.

A switching device 37 may selectively connect first capacity control device 24' and second capacity control device 31 to amplifier 28. For example, switching device 37 may connect first capacity control device 24' to amplifier 28, so that signal comparing device 27 may send a feedback signal to capacity adjustment device 17*a*. Switching device 37 may connect second capacity control device 31 to amplifier 28, so that signal comparing device 36 may send a feedback signal to capacity adjustment device 17*a* Switching device 37 may be activated by an external controller (not shown). External controller may activate switching device 37 to connect first capacity control device 24' or second capacity control device 31 to amplifier 28 depending upon a desired outcome, e.g., reducing energy consumption, matching a load of compressor 2' to a load of the vehicle engine, controlling the flow of refrigerant in the refrigeration circuit, or the like.

Thus, according to one embodiment of the invention, a discharge capacity control device may regulate the discharge capacity of a compressor directly, e.g., by detecting the discharge capacity of a compressor and regulating the detected discharge capacity toward a predetermined discharge capacity control value, without regard to other factors that may affect the discharge capacity of the compressor. Moreover, according to another embodiment of the invention, a discharge capacity control device may regulate the discharge capacity of a compressor indirectly, e.g., by detecting a pressure or a temperature of a refrigeration circuit, so that the detected discharge capacity may be adjusted based on a variety of considerations, e.g., reducing energy consumption, matching a load of compressor 2', to a load of the vehicle engine, controlling the flow of refrigerant in the refrigeration circuit, or the like. In addition, the discharge capacity control device of the present invention may regulate discharge capacity by a feedforward control, so that discharge capacity of the compressor may be regulated in an efficient manner.

While the invention has been described in connection with preferred embodiments, the invention is not limited thereto. It will be understood by those skilled in the art that other embodiments, variations and modifications of the invention will be apparent to those of ordinary skill in the art from a consideration of the specification or a practice of the invention disclosed herein and may be made within the scope of the invention.

What is claimed is:

1. A method of controlling a discharge capacity of a variable capacity compressor connected to a refrigeration circuit, comprising the steps of:

setting a first discharge capacity target value of said variable capacity compressor;

detecting a discharge capacity of said variable capacity compressor and transmitting a discharge capacity signal corresponding thereto;

comparing said discharge capacity signal with said first discharge capacity target value; and adjusting said discharge capacity of said variable capacity compressor, such that said discharge capacity value approaches said first discharge capacity, target value.

2. The method of claim 1, further comprising the steps of:

detecting a first pressure value in said refrigeration circuit;

setting a second pressure target value;

comparing said first pressure value with said second pressure target value;

adjusting a discharge capacity of said variable capacity compressor, such that said first pressure value approaches said second pressure target value.

3. The method of claim 2, wherein the step of adjusting a discharge capacity of said variable capacity compressor comprises the steps of:

connecting a second signal comparing, device to a capacity adjustment device; and sending a second activation signal to said capacity adjustment device, which adjusts said discharge capacity based on said second activation signal, such that said first pressure value approaches said second pressure target value.

4. The method of claim 1, further comprising the steps of:

detecting a first temperature value in said refrigeration circuit;

setting a second temperature target value;

comparing said first temperature value with said second temperature target value;

adjusting a discharge capacity of said variable capacity compressor, such that said first temperature value approaches said second temperature target value.

5. The method of claim 4, wherein the step of adjusting a discharge capacity of said variable capacity compressor comprises the steps of:

connecting a second signal comparing device to a capacity adjustment device; and sending a second activation signal to said capacity adjustment device, which adjusts said discharge capacity based on said second activation signal, such that said fist temperature value approaches said second temperature target value.

6. The method of claim 1, wherein the step of adjusting a discharge capacity of said variable capacity compressor comprises the steps of:

connecting a first signal comparing device to a capacity adjustment device; and sending a first activation signal to said capacity adjustment device, which adjusts said discharge capacity based on said first activation signal, such that said discharge capacity value approaches said first discharge capacity target value.

7. An apparatus for controlling compressor discharge capacity comprising:

a variable capacity compressor;

a capacity adjustment device, which regulates a discharge capacity of said variable capacity compressor;

a signal processing device, which receives a signal corresponding to a discharge capacity of said variable capacity compressor;

a capacity setting device, which sets a first discharge capacity target value for said variable capacity compressor; and a signal comparing device, which compares said discharge capacity signal to said first discharge capacity target value and sends an activation signal to said capacity adjustment device, such that said discharge capacity signal approaches said first discharge capacity target value.

8. The apparatus of claim 7, wherein said variable capacity compressor is connected to a refrigeration circuit of a vehicle air conditioning system.

9. The apparatus of claim 7, wherein said variable capacity compressor is a swash plate-type, variable displacement compressor.

10. The apparatus of claim 7, further comprising:

a feedforward control, which controls said signal comparing device, such that said discharge signal approaches said first discharge capacity target value.

11. An apparatus for controlling compressor discharge capacity comprising:

a variable capacity compressor;

a capacity adjustment device, which regulates a discharge capacity of said variable capacity compressor;

a signal processing device, which receives a signal corresponding to a discharge capacity of said variable capacity compressor;

a capacity setting device, which sets a first discharge capacity target value of said variable capacity compressor;

a first signal comparing device, which compares said discharge capacity signal to said first discharge capacity target value and sends a first activation signal to said capacity adjustment device, such that said discharge capacity signal approaches said first discharge capacity value;

a detection device, which detects a first pressure value in a refrigeration circuit including said variable capacity compressor;

a pressure setting device, which sets a second pressure value;

a second signal comparing device, which compares said first pressure value with said second pressure value and sends a second activation signal to said capacity adjustment device, such that said first pressure value approaches said second pressure value.

12. The apparatus of claim 11, further comprising:

a switching device, which selectively connects said first signal comparing device to said capacity adjustment device, so that said first signal comparing device sends said first activation signal to said capacity adjustment device.

13. The apparatus of claim 11, further comprising:

a switching device, which selectively connects said second signal comparing device to said capacity adjustment device, so that said second signal comparing device sends said second activation signal to said capacity adjustment device.

14. The apparatus of claim 11, wherein said variable capacity compressor is connected to a refrigeration circuit of a vehicle air conditioning system.

15. The apparatus of claim 11, wherein said variable capacity compressor is a swash plate-type, variable displacement compressor.

16. The apparatus of claim 11, further comprising:

a feedforward control, which controls said fist signal comparing device, such that said discharge signal approaches said first discharge capacity value and which controls said second signal comparing device, such that said first pressure value approaches said second pressure value.

17. An apparatus for controlling compressor discharge capacity comprising:

a variable capacity compressor;

a capacity adjustment device, which regulates a discharge capacity of said variable capacity compressor;

a signal processing device, which receives a signal corresponding to a discharge capacity of said variable capacity compressor;

a capacity setting device, which sets a first discharge capacity target value of said variable capacity compressor;

a first signal comparing device, which compares said discharge capacity signal to said first discharge capacity target value and sends a first activation signal to said capacity adjustment device, such that said discharge capacity signal approaches said first discharge capacity value;

a detection device, which detects a first temperature value in a refrigeration circuit including said variable capacity compressor;

a pressure setting device, which sets a second temperature value;

a second signal comparing device, which compares said first temperature value with said second temperature value and sends a second activation; signal to said capacity adjustment device, such that said first temperature value approaches said second temperature value.

18. The apparatus of claim 17, further comprising:

a switching device, which selectively connects said first signal comparing device to said capacity adjustment, device so that said first signal comparing device sends said first activation signal to said capacity adjustment device.

19. The apparatus of claim 17, further comprising:

a switching device, which selectively connects said second signal comparing device to said capacity adjustment device, so that said second signal comparing device sends said second activation signal to said capacity adjustment device.

20. The apparatus of claim 17, wherein said variable capacity compressor is connected to a refrigeration circuit of a vehicle air conditioning system.

21. The apparatus of claim 17, wherein said variable capacity compressor is a swash plate-type, variable displacement compressor.

22. The apparatus of claim 17, further comprising:

a feedforward control, which controls said first signal comparing device, such that said discharge signal approaches said first discharge capacity value and which controls said second signal comparing device, such that said first temperature value approaches said second temperature value.

* * * * *